US009637354B2

(12) United States Patent
Forston et al.

(10) Patent No.: US 9,637,354 B2
(45) Date of Patent: May 2, 2017

(54) DEVICES AND METHODS FOR HANDLING RADIUS FILLERS

(71) Applicant: The Boeing Company, Huntington Beach, CA (US)

(72) Inventors: Gabriel Zane Forston, Lake Stevens, WA (US); Elise Rae Ermitano Castorina, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 183 days.

(21) Appl. No.: 14/518,754

(22) Filed: Oct. 20, 2014

(65) Prior Publication Data

US 2016/0107864 A1 Apr. 21, 2016

(51) Int. Cl.
*B66C 1/00* (2006.01)
*B66C 1/28* (2006.01)
*B66C 1/62* (2006.01)

(52) U.S. Cl.
CPC . *B66C 1/28* (2013.01); *B66C 1/62* (2013.01)

(58) Field of Classification Search
CPC .... B66C 1/32; B66C 1/16; B66C 1/62; B66C 1/28; E21B 19/07; E21B 7/046; E04H 17/265; B66F 3/24; F16L 1/06
USPC ..... 294/67.4, 67.5, 81.55, 113; 254/29 R, 254/30, 93 R; 405/184.4
See application file for complete search history.

(56) References Cited

U.S. PATENT DOCUMENTS 2,617,678 A * 11/1952 Kelso ..... B66C 1/422 294/113
3,451,711 A * 6/1969 Carpenter ..... B66C 1/422 294/106
3,561,615 A * 2/1971 Forsberg ..... F16L 1/09 29/237
4,284,385 A * 8/1981 Lively ..... B23K 37/0533 29/237
6,079,698 A * 6/2000 Patterson ..... F16F 15/085 267/136
6,709,538 B2 3/2004 George et al.
8,029,036 B2 * 10/2011 Kline ..... F16L 1/06 254/93 R (Continued)

OTHER PUBLICATIONS

Melilli, "Applying Automation to the Fabrication of Composite-Based Aerospace Parts", JEC Magazine #56, Apr. 2010. http://www.jeccomposites.com/news/features/automation/applying-automation-fabrication-composite-based-aerospace-parts.

*Primary Examiner* — Stephen Vu

(74) *Attorney, Agent, or Firm* — DASCENZO Intellectual Property Law, P.C.

(57) ABSTRACT

Devices and methods for handling uncured radius fillers are disclosed. The devices, i.e., radius filler transport tools, generally are configured to load a radius filler from above, to index the radius filler to a desired location (e.g., a cavity), and to downwardly unload (e.g., drop) the radius filler at the desired location. Radius filler transport tools comprise at least two trough portions, coupled together to form a trough to carry the radius filler, and a plurality of hanger assemblies configured to transversely span the trough. The radius filler transport tool may have a transport state, where the trough and the hanger assemblies are in closed states, a load state, where the trough is in the closed state and at least one hanger assembly is in an open state, and an unload state, where the trough is in an open state and the hanger assemblies are in closed states.

20 Claims, 8 Drawing Sheets

(56) References Cited

U.S. PATENT DOCUMENTS

| | | | |
|---|---|---|---|
| 8,540,833 | B2 | 9/2013 | Deobald et al. |
| 2014/0216638 | A1 | 8/2014 | Vetter et al. |

* cited by examiner

DEVICES AND METHODS FOR HANDLING RADIUS FILLERS

FIELD

The present disclosure relates to devices and methods for handling radius fillers.

BACKGROUND

Fiber-reinforced composite structures often include a sheet structure in which layers of a composite material, such as a pre-impregnated (or prepreg) material, may be bent, wrapped, and/or otherwise extended between a first plane, or surface, and a second plane, or surface. The finite thickness and/or mechanical stiffness of the sheets of composite material result in a finite bend, or radius of curvature, in a transition region between the first surface and the second surface; and, in some geometries, this finite radius of curvature results in a cavity (e.g., a void space) between adjacent sheets of composite material.

This cavity may be filled with, or otherwise occupied by, a filler material, such as a radius filler, which also may be referred to as a noodle. The radius filler may be configured to provide mechanical support to the sheets of composite material that are proximal thereto and/or to decrease a potential for distortion of the sheets of composite material while the composite structure is curing.

Before curing the composite structure with a radius filler, the uncured radius filler needs to be transported to and placed into the cavity between the adjacent sheets of composite material. Radius fillers may be long, e.g., 1-40 m or more, with a relatively small cross section, e.g., a cross sectional area on the order of 1 $cm^2$ (e.g., 0.1-10 $cm^2$), and, hence, may be very easily twisted, kinked, and/or warped. Conventional methods of transporting radius fillers include hand manipulation and/or carrying (with multiple individuals, each managing a different section), sometimes augmented by long carts. Once the radius filler is brought to its destination (the location of the cavity between the composite sheets), the radius filler typically is manually placed into the cavity (with multiple individuals, each managing a different section). Particularly long radius fillers present significant challenges when manipulated, maneuvered, and installed due to difficulty in coordinating multiple individuals and the varying skill of multiple individuals while avoiding warping, kinking, and/or twisting so as to maintain acceptable quality for the radius fillers' intended application.

SUMMARY

Devices and methods for handling uncured radius fillers are disclosed herein. The devices, i.e., radius filler transport tools, comprise at least two trough portions, coupled together to form a trough, and a plurality of hanger assemblies configured to transversely span the trough. The trough portions each include a trough panel and a base. The trough has a closed state, where the bases of the trough portions are releasably coupled together, and an open state, where the bases are released from each other. Further, each hanger assembly includes at least two arms, each arm pivotably coupled to a different trough portion. Each hanger assembly has a closed state, where the arms are coupled together and to the corresponding trough portion to span the trough, and an open state, where at least one arm is released from at least one of the corresponding trough portion and the other arms.

The radius filler transport tool generally is configured to load a radius filler from above, to index (e.g., to transport and/or to align) the radius filler to a desired location (e.g., a cavity), and to downwardly unload (e.g., drop) the radius filler at the desired location. Further, the radius filler transport tool may have a transport state, where the trough is in the closed state and the hanger assemblies are in closed states, a load state, where the trough is in the closed state and at least one hanger assembly is in the open state, and an unload state, where the trough is in the open state and the hanger assemblies are in closed states.

Methods for handling uncured radius fillers comprise loading the uncured radius filler into a radius filler transport tool by placing the uncured radius filler into the radius filler transport tool from above and subsequently unloading the uncured radius filler from the radius filler transport tool by dropping the uncured radius filler from the radius filler transport tool.

DESCRIPTION

Figure 1:
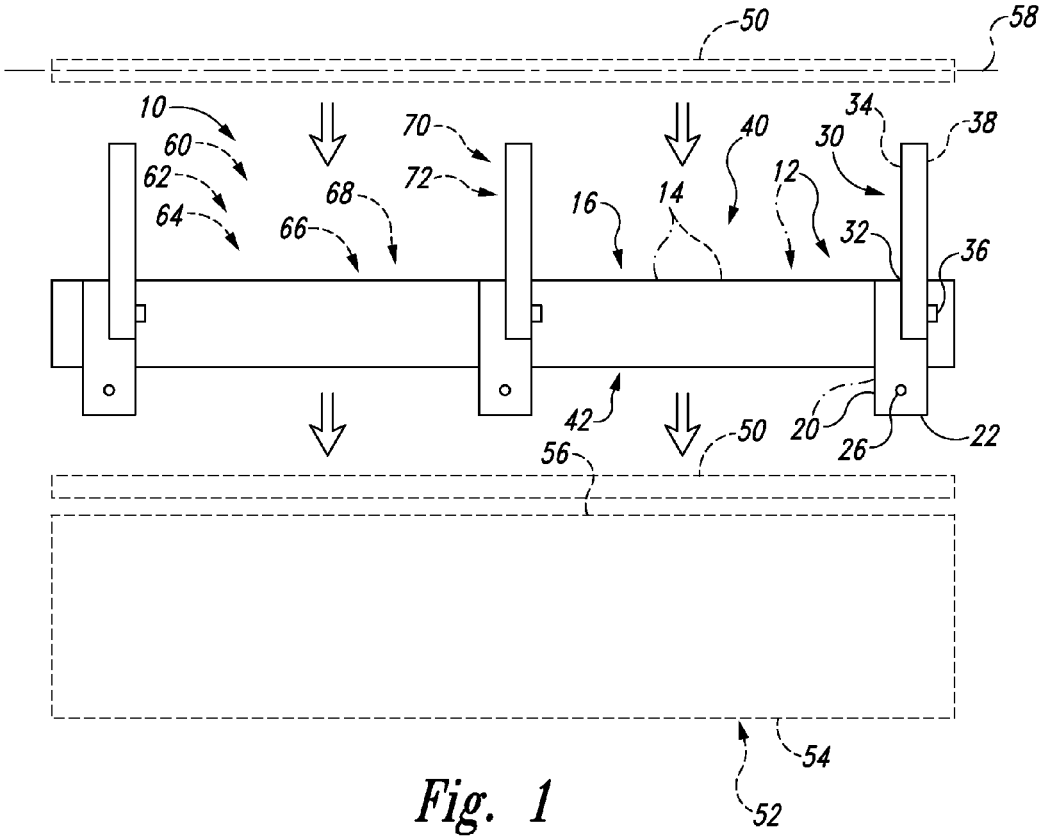
FIG. 1 is a schematic side-view representation of radius filler transport tools.

Devices and methods for handling radius fillers are disclosed herein. In general, in the drawings, elements that are likely to be included in a given embodiment are illustrated in solid lines, while elements that are optional or alternatives are illustrated in dashed lines. However, elements that are illustrated in solid lines are not essential to all embodiments of the present disclosure, and an element shown in solid lines may be omitted from a particular embodiment without departing from the scope of the present disclosure. Elements that serve a similar, or at least substantially similar, purpose are labeled with numbers consistent among the figures. Like numbers in each of the figures, and the corresponding elements, may not be discussed in detail herein with reference to each of the figures. Similarly, all elements may not be labeled in each of the figures, but reference numerals associated therewith may be used for consistency. Elements, components, and/or features that are discussed with reference to one or more of the figures may be included in and/or used with any of the figures without departing from the scope of the present disclosure.

FIG. 1 is a schematic side-view representation of a radius filler transport tool 10. Radius filler transport tool 10 generally is configured to load, to index (e.g., to transport and/or to align), and to unload an uncured radius filler 50 and may have corresponding load states 62, transport states 60, and/or unload states 64. Radius filler transport tool 10 is configured to load the radius filler 50 from above through a reconfigurable radius filler entrance 40, and to unload the radius filler 50 downwardly through a reconfigurable radius filler exit 42.

Figure 2:
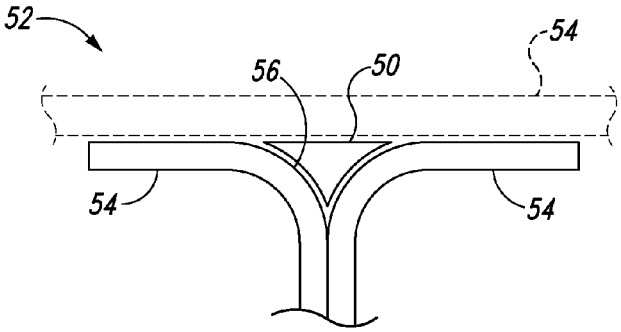
FIG. 2 is a schematic end-view representation of an illustrative, non-exclusive example of a radius filler in a composite structure.

FIG. 2 is a schematic end-view representation of an illustrative, non-exclusive example of a composite structure 52 that includes a radius filler 50. Various apparatuses, including aerospace apparatuses, may be at least partially constructed of composite structures. For example, composite structures may form at least a part of a stringer, a spar, a rib, a frame, an airframe, a fuselage, a wing, an empennage, an airfoil, and/or a rotor blade. Further, other apparatuses may include composite structures, such as spacecraft, watercraft, land vehicles, wind turbines, structural towers and masts, etc.

Composite structures 52 are substantially composed of fiber-reinforced composite materials, i.e., materials that include reinforcement fibers such as carbon fiber, glass fiber, and/or polyamide fiber. The fibers may be in the form of a tow, a weave, a knit, a fabric, and/or a felt. Fiber-reinforced composite materials also include a resin such as an epoxy, a thermoset material, and/or a thermoplastic material. When the resin is in an incompletely cured state, the fiber-reinforced material is said to be uncured.

One or more components of composite structures 52 may be in the form of a composite sheet 54 and may include layers, plies, and/or laminae. Composite sheets 54 may contact other composite sheets 54 of the composite structure 52 at a joint, bend, or other interface. At these interfaces, composite sheets 54, or other composite components, may bend and/or terminate, leaving a cavity 56 (e.g., a void space) between adjoining components, owing at least partially to the finite thickness and/or radius of curvature of the components. For example, composite stringers (e.g., T-profile, I-profile, and/or hat profile) may leave a cavity 56 between portions of the stringer and/or between the stringer and the supported composite component (e.g., a sheet, panel, and/or skin). As another example, lap joints (where one sheet of material is layered over another sheet of material) may leave a cavity 56 at the edge of one of the layered sheets.

Composite structures 52 may be quite large and/or long, and interfaces in the composite structures 52 may substantially span the composite structure 52. Hence, cavities 56 may be long and/or narrow (in FIG. 1, the longitudinal direction is indicated by the system longitudinal axis 58; in FIG. 2, the longitudinal direction is perpendicular to the page). For example, cavities may be longer than 1 m, longer than 2 m, longer than 3 m, longer than 4 m, longer than 5 m, longer than 10 m, longer than 20 m, longer than 30 m, and/or longer than 40 m, and/or may have a transverse width of less than 10 cm, less than 5 cm, less than 2 cm, and/or less than 1 cm.

Cavities 56 may be filled by a radius filler 50 (also called a noodle). Radius fillers 50 include a resin and/or adhesive and generally are composite materials such as fiber-reinforced materials. Radius fillers 50 are formed to substantially match the shape of the designated cavity 56. Typically, a cavity 56 is filled with one radius filler 50 that extends substantially the full length of the cavity 56. Hence, radius fillers 50 may be too long to be conveniently handled by one person without tools (e.g., too long to be handheld) and may be longer, and/or substantially longer, than an arm span. Radius fillers 50 typically are long and/or narrow, for example, with a length that is longer than 1 m, longer than 2 m, longer than 3 m, longer than 4 m, longer than 5 m, longer than 10 m, longer than 20 m, longer than 30 m, and/or longer than 40 m, and, for example, with a cross sectional area that is less than 10 $cm^2$, less than 3 $cm^2$, less than 2 $cm^2$, less than 1 $cm^2$, less than 0.5 $cm^2$, less than 0.2 $cm^2$, greater than 0.1 $cm^2$, greater than 0.2 $cm^2$, and/or greater than 0.5 $cm^2$.

Uncured radius fillers 50 may be placed in cavities 56 while the components that define the cavity 56 are uncured. Subsequently, the uncured composite structure 52, including the uncured components (e.g., uncured composite sheets 54) and uncured radius filler 50 may be cured concurrently. Uncured radius fillers 50, as with uncured composite materials in general, are flexible and, owing to the uncured state, generally sticky (e.g., susceptible to contamination and sticking to surfaces). Placing the uncured radius filler 50 into a cavity 56 defined by uncured components is susceptible to unintended warping, kinking, and/or twisting of the uncured radius filler 50.

Returning to FIG. 1, radius filler transport tool 10 comprises at least two trough portions 12, e.g., one on each side. FIG. 1 is a side view, with just one of the trough portions 12 is visible; hidden trough portions 12 are schematically indicated by dot-dash lead lines. The trough portions 12 are configured to couple together to form a trough 16, the trough 16 being configured to hold the uncured radius filler 50, at least while the radius filler transport tool 10 is in the load state 62 and/or transport state 60. The trough 16 may be described as an elongated channel and/or receptacle with a generally closed bottom and an open top. Each trough portion 12 includes a trough panel 14 and a base 20 (hidden trough panels 14 and bases 20 are schematically indicated by dot-dash lead lines). The trough 16, the trough portions 12, and/or the trough panels 14 are generally longitudinally rigid and/or configured to hold the uncured radius filler 50 without significant warping, kinking, and/or twisting. Because the radius filler transport tool 10 is configured to carry a radius filler 50, the radius filler transport tool 10, the trough 16, the trough portions 12, and/or the trough panels 14 may be elongated with a length of longer than 1 m, longer than 2 m, longer than 3 m, longer than 4 m, longer than 5 m, longer than 10 m, longer than 20 m, longer than 30 m, and/or longer than 40 m.

The trough 16 has a trough closed state 66 and a trough open state 68 (both related to the transport state 60, the load state 62, and/or the unload state 64 as discussed further herein). In the trough closed state 66, the base 20 of at least one trough portion 12 is releasably coupled to the base 20 of another trough portion 12. Hence, at least the trough panels 14 of the trough portions 12 are brought together to form a generally closed-bottom trough 16. The depth of the trough 16 in the trough closed state 66 (i.e., the distance from the bottom to the top of the trough 16) may be greater than 5 mm, greater than 10 mm, greater than 15 mm, greater than 20 mm, greater than 25 mm, greater than 30 mm, less than 100 mm, less than 50 mm, less than 40 mm, and/or less than 30 mm. In the trough open state 68, the base 20 of at least one trough portion 12 is released, i.e., disconnected and/or free to separate, from the base 20 of another trough portion 12 (an opposing trough portion 12). Hence, the trough panels 14 of the trough portions 12 are free to separate at their respective bases 20 and form an open-bottom trough 16. The open bottom of the trough 16 in the trough open state 68 substantially defines the radius filler exit 42. That is, a radius filler 50 in the trough 16 may (downwardly) exit the radius filler transport tool 10 through the open bottom of the trough 16 in the trough open state 68.

Each trough portion 12 may independently include a plurality of trough panels 14. For example, a group of the trough panels 14 for one trough portion 12 may be arranged end to end to form an elongated trough panel assembly. Individual trough panels 14 may be longer than 0.5 m, longer than 1 m, longer than 2 m, longer than 3 m, longer than 4 m, longer than 5 m, shorter than 5 m, shorter than 4 m, shorter than 3 m, shorter than 2 m, and/or shorter than 1 m. Trough panels 14 may be configured to retain an elongated shape when supported in a spaced apart manner (i.e., with spaced apart supports) and/or to avoid sticking to, contaminating, and/or otherwise negatively impacting an uncured radius filler 50 (i.e., trough panels 14 may be compatible with uncured radius filler 50). Moreover, trough panels 14 may be configured to avoid contaminating, sticking to, and/or otherwise negatively impacting uncured radius fillers 50, i.e., trough panels 14 may be configured for non-damaging contact of uncured radius fillers 50, causing little or no contamination (e.g., due to transfer from the trough panel 14 to the uncured radius filler 50), distortion (e.g., warping, stretching), and/or harm (e.g., due to sticking, pinching, scratching, etc.) of the uncured radius filler 50. For example, trough panels 14 may include, and/or may be, a structural material, a non-stick material (e.g., an oleophobic, a lipophobic, and/or a hydrophobic material), an unreactive material, and/or an inert material. As another example, trough panels 14 may be adapted and/or designed for longitudinal rigidity, e.g., composed essentially of structural materials and/or including ridges, ribs, flanges, and/or braces. Suitable materials for trough panels 14 include plastic, polyethylene, UHMW (ultra-high molecular weight) polyethylene, metal, aluminium, fluoropolymer, PTFE (polytetrafluoroethylene), FEP (fluorinated ethylene propylene), EFTE (ethylene tetrafluoroethylene), and silicone. Additionally or alternatively, trough panels 14 may include a release coating, a release film, and/or a dry release surface (e.g., a film, coating, and/or surface of PTFE, FEP, EFTE, and/or silicone).

Each trough portion 12 may independently include a plurality of bases 20, the bases 20 optionally separated and/or spaced apart along the corresponding trough portion 12. For example, the bases 20 may be separated and/or spaced apart by at least 1 m, at least 2 m, at least 3 m, at least 4 m, at least 5 m, about 1 m, about 1.5 m, and/or about 2 m. Bases 20, individually and/or collectively, may be configured to stably rest on a flat surface and/or support at least a portion of the radius filler transport tool 10. The radius filler transport tool 10, at least when the trough 16 is in the trough closed state 66, may be configured to stably rest on a flat surface with at least one base 20 of each trough portion 12 contacting the flat surface. Each base 20 may include a foot 22 (e.g., at the bottom of the base 20 and/or the radius filler transport tool 10), with each foot 22 optionally configured to contact uncured composite materials (e.g., composite structure 52 and/or composite sheets 54) without damage to the uncured composite materials. For example, feet 22 may include, and/or may be, a non-stick material (e.g., an oleophobic, a lipophobic, and/or a hydrophobic material). Suitable materials for bases 20 and/or feet 22 include plastic, polyethylene, UHMW polyethylene, metal, aluminium, fluoropolymer, PTFE, FEP, EFTE, and silicone. Additionally or alternatively, feet 22 may include a release coating, a release film, and/or a dry release surface (e.g., a film, coating, and/or surface of PTFE, FEP, EFTE, and/or silicone).

Figure 3:
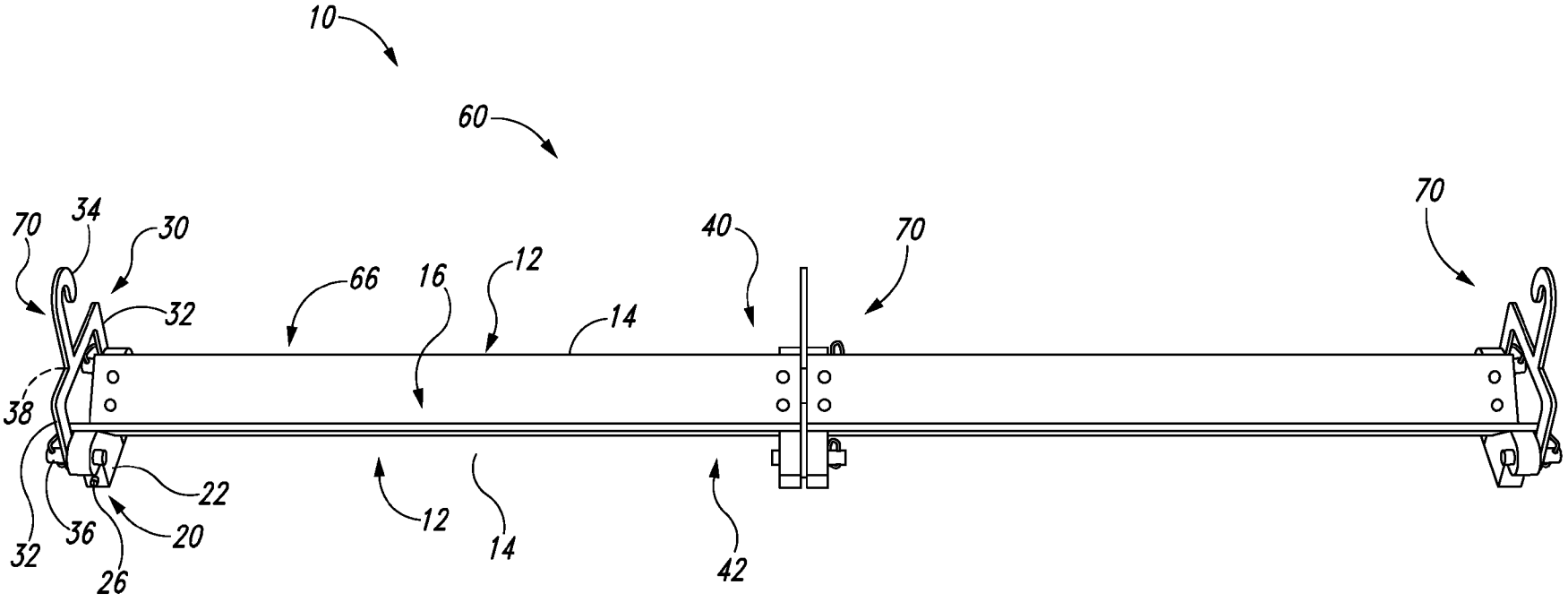
FIG. 3 is a perspective view of an illustrative, non-exclusive example of a radius filler transport tool in the transport state.

Radius filler transport tool 10 may include a base coupler 26 which is configured to couple bases 20 of different trough panels 12 together. As an example, FIG. 3 illustrates a radius filler transport tool 10 with two trough portions 12, each trough portion 12 including one or more bases 20 aligned with mating and/or corresponding base(s) 20 of the other trough portion 12. In the trough closed state 66, each pair of bases 20 (mating and/or corresponding bases 20 of opposite trough portions 12) are proximate each other and coupled together with a base coupler 26. Base couplers 26 may include, and/or may be, a pin, a clamp, a clasp, a hinge, a magnet, and/or an actuator. Base couplers 26, bases 20, and/or trough portions 12 may be configured to be releasable. For example, to transition from the trough closed state 66 to the trough open state 68, the base coupler(s) 26 may be released, uncoupled, and/or removed to release the bases 20 from each other and, thus, at least a section of the trough portions 12 from each other.

Radius filler transport tool 10 also comprises a plurality of hanger assemblies 30 configured to transversely span the trough 16, i.e., each hanger assembly 30 transversely spans the trough 16, at least while the radius filler transport tool 10 is in the transport state 60. The plurality of hanger assemblies 30 is configured to hang (i.e., support from above) the radius filler transport tool 10, at least while in the transport state 60, and to maintain the trough 16 in the trough closed state 66 while the radius filler transport tool 10, in the transport state 60, is hanging by the plurality of hanger assemblies 30. The hanger assemblies 30 generally are spaced apart along the length of the radius filler transport tool 10 and may be separated and/or spaced apart by at least 1 m, at least 2 m, at least 3 m, at least 4 m, at least 5 m, about 1 m, about 1.5 m, and/or about 2 m. The plurality of hanger assemblies 30 is configured to provide the sole support for the radius filler transport tool 10 while the radius filler transport tool 10 is hanging by the plurality of hanger assemblies 30. Hence, the radius filler transport tool 10, the trough 16, and/or the trough portions 12 are, collectively and/or individually, rigid enough to maintain the trough 16 in the trough closed state 66 while hanging and/or rigid enough to maintain the uncured radius filler 50 in the trough 16 without significant warping, kinking, and/or twisting of the radius filler 50.

Each hanger assembly 30 includes at least two arms 32, with one arm 32 configured to pivotably couple the hanger assembly 30 to at least one trough portion 12, and with another arm 32 configured to pivotably couple the hanger assembly 30 to another trough portion 12. Each hanger assembly 30 has a hanger closed state 70 and a hanger open state 72. In the hanger closed state 70, at least one arm 32 is pivotably coupled to at least one trough portion 12, another arm 32 is pivotably coupled to another trough portion 12, and the hanger assembly 30 transversely spans the trough 16. In the hanger open state 72, at least one arm 32 is released from the corresponding trough portion(s) 12 and/or the arms 32 are released from each other to permit access to the open top of the trough 16 from above. The radius filler entrance 40 is substantially defined by the open top of the trough 16 and the hanger assemblies 30 in the hanger open state 72. That is, a radius filler 50 may be inserted into at least a portion of the trough 16 from above the radius filler transport tool 10 when the corresponding hanger assembly(ies) 30 is in the hanger open state 72.

Figure 4:
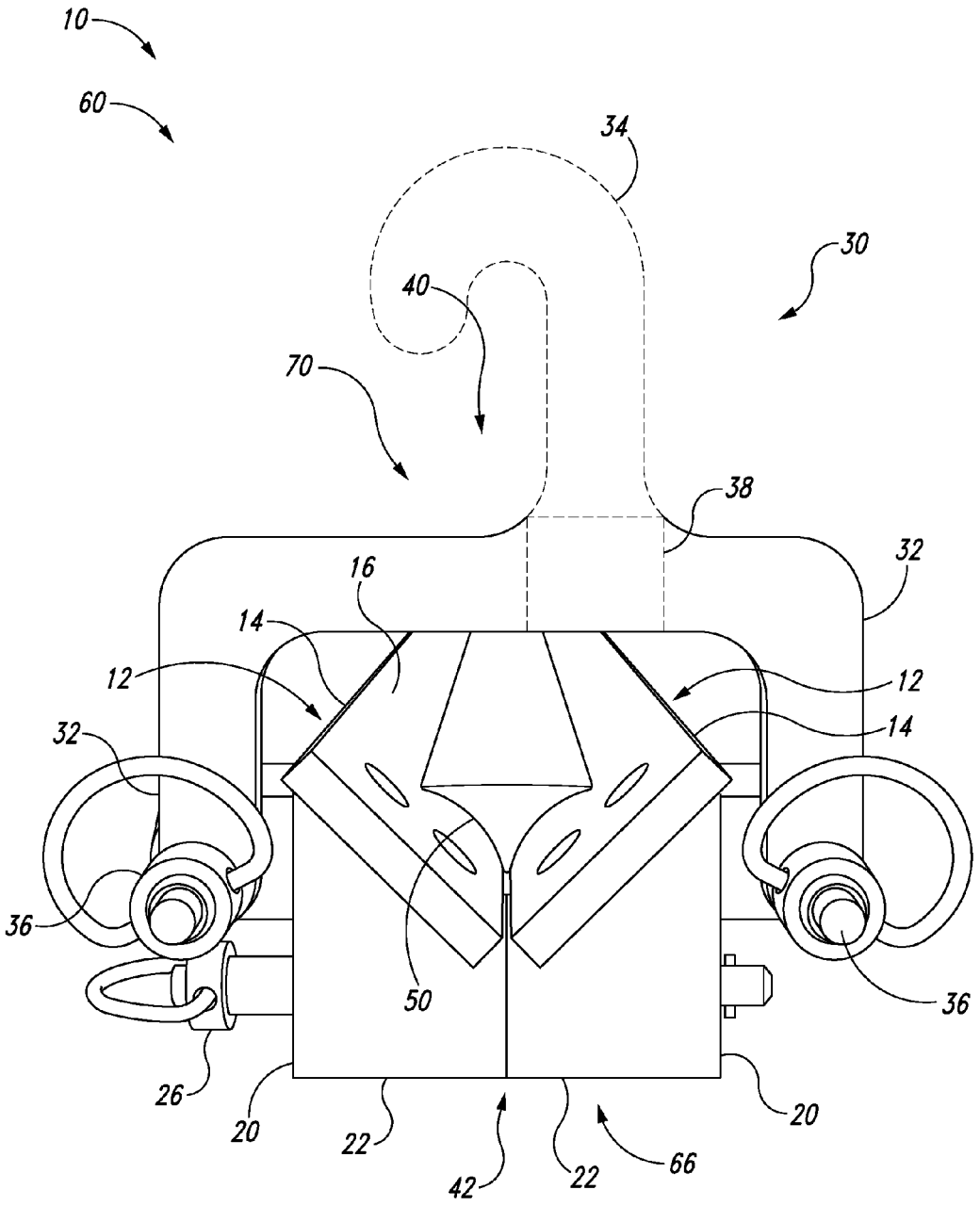
FIG. 4 is a perspective end view of the radius filler transport tool of FIG. 3.

Hanger assemblies 30 may include an arm coupler 36 for each arm 32. When present, the arm couplers 36 are configured to couple the corresponding arm 32 of the hanger assembly 30 to at least one of the trough portions 12. Arm couplers 36 are configured to pivotably couple the corresponding arm 32 and trough portion 12 together. As an example, FIG. 4 illustrates a radius filler transport tool 10 with a hanger assembly 30 in the hanger closed state 70. Each arm 32 of the hanger assembly 30 is pivotably coupled to one trough portion 12, with one arm coupler 36 for each coupled arm 32 and trough portion 12. The pivotal coupling between the arm 32 and the trough portion 12 allows the trough portion 12 to rotate with respect to the coupled arm 32 while the two components remain coupled. Arm couplers 36 may include, and/or may be, a pin, a clamp, a clasp, a hinge, a magnet, an actuator, a hook, a ring, a carabiner, a link, a loop, and/or an eyelet. At least one arm coupler 36, and optionally each arm coupler 36, may be configured to be releasable. For example, to transition from the hanger closed state 70 to the hanger open state 72, at least one arm coupler 36 may be released, uncoupled, and/or removed to release the arm 32 from the trough panel 12. If all arm couplers 36 are released, uncoupled, and/or removed, the hanger assembly 30 is free of the trough portions 12 and the trough 16 and may be removed from the radius filler transport tool 10, fully exposing the top of the trough 16 and the radius filler entrance 40. If at least one arm coupler 36 remains coupling the corresponding arm 32 and trough portion 12, the hanger assembly 30 may pivot about that arm coupler 36 and rotate away from the trough 16, fully exposing the top of the trough 16 and the radius filler entrance 40.

Hanger assemblies 30 may include a central hanger coupler 38 that couples at least two arms 32 of the hanger assembly together, specifically two arms 32 that are each configured to be coupled to a different trough portion 12. The central hanger coupler 38 may be releasable. When the central hanger coupler 38 is released, uncoupled, and/or removed, the coupled arms 32 of the hanger assembly 30 are free to separate from each other. For example, to transition from the hanger closed state 70 to the hanger open state 72, the central hanger coupler 38 may be released, uncoupled, and/or removed, leaving the arms 32 of the hanger assembly 30 free to pivot about the corresponding arm couplers 36. In such a case, the arms 32 may be rotated away from the trough 16 to fully expose the top of the tough 16 and the radius filler entrance 40. Central hanger couplers 38 may include, and/or may be, a pin, a clamp, a clasp, a hinge, a magnet, an actuator, a hook, a ring, a carabiner, a link, a loop, and/or an eyelet.

Hanger assemblies 30 may include a hanging coupler 34 which is configured to releasably couple the hanger assembly 30 to a transport mechanism above the radius filler transport tool 10 and/or configured to hang the radius filler transport tool 10 from above. Hanging couplers 34 may include, and/or may be, a hook, a ring, a carabiner, a link, a catch, a clasp, a grapple, a loop, a strap, a tether, and/or an eyelet. Though the examples of FIGS. 3-8 illustrate the optional hanging coupler 34 as a hook suitable to attach to a cable, strap, loop, ridge, etc., hanging assemblies 30 do not require any specific hanging coupler 34. Hanging assemblies 30 may omit the hanging coupler 34 and yet still be hung by hook, cable, strap, loop, etc. of a transport mechanism such as an overhead crane, mobile transport cart, etc.

The transport state 60, the load state 62, and the unload state 64 of the radius filler transport tool 10 may be described in terms of the trough state and the hanger assembly state(s). The radius filler transport tool 10 in the transport state 60 is configured to hold a radius filler 50 in the trough 16 between at least two trough portions 12 (e.g., between two trough panels 14) when the trough 16 is in the trough closed state 66 and each hanger assembly 30 is in the hanger closed state 70.

The radius filler transport tool 10 in the load state 62 is configured to load a radius filler 50 from above the radius filler transport tool 10 into the trough 16 through the radius filler entrance 40 when the trough 16 is in the trough closed state 66 and at least one, optionally each, hanger assembly 30 is in the hanger open state 72. The radius filler 50 may be loaded into the trough 16 one section at a time by opening a hanger assembly 30, inserting the section of radius filler past the open hanger assembly 30, and then continuing for each hanger assembly 30. Hence, the radius filler transport tool 10 in the load state 62 may be configured to load a section of the radius filler 50. The radius filler transport tool 10 in the load state 62 may be configured to accept the radius filler 50 placed, dropped, and/or ejected into the trough 16 from above.

The radius filler transport tool 10 in the unload state 64 is configured to downwardly unload a radius filler 50 from the trough 16 when the trough 16 is in the trough open state 68 and each hanger assembly 30 is in the hanger dosed state 70. The radius filler transport tool 10 in the unload state 64 may be configured to drop, eject, and/or place the radius filler 50 from the trough 16 into a cavity 56 in a composite structure 52. The radius filler 50 may be dropped, ejected, and/or placed from the trough 16 one section at a time by opening opposing trough portions 12 at one or more (but not all) of their respective bases 20 (i.e., releasing, disconnecting, and/or separating the bases 20), and then continuing for each base 20. Hence, the radius filler transport tool 10 in the unload state 64 may be configured to drop, eject, and/or place a section of the radius filler 50. When dropped, ejected, and/or placed, the radius filler 50 generally moves from the trough 16 to the cavity 56 below the trough 16. To avoid stretching, twisting, kinking, and/or pulling the radius filler 50 as it is dropped, ejected, and/or placed, the radius filler transport tool 10 may be configured to hold the radius filler 50 close to the bottom of the radius filler transport tool 10, the trough 16 may be configured with a bottom close to the bottom of the radius filler transport tool 10, and/or the radius filler transport tool 10 may be configured to closely approach a cavity 56. The distance between the bottom of the trough 16 and the top of the cavity 56, and/or the distance between the bottom of the trough 16 and the bottom of the radius filler transport tool 10 (which is generally above the cavity 56) may be less than 100 mm, less than 50 mm, less than 40 mm, less than 30 mm, less than 25 mm, less than 20 mm, less than 15 mm, and/or less than 10 mm.

Figure 5:
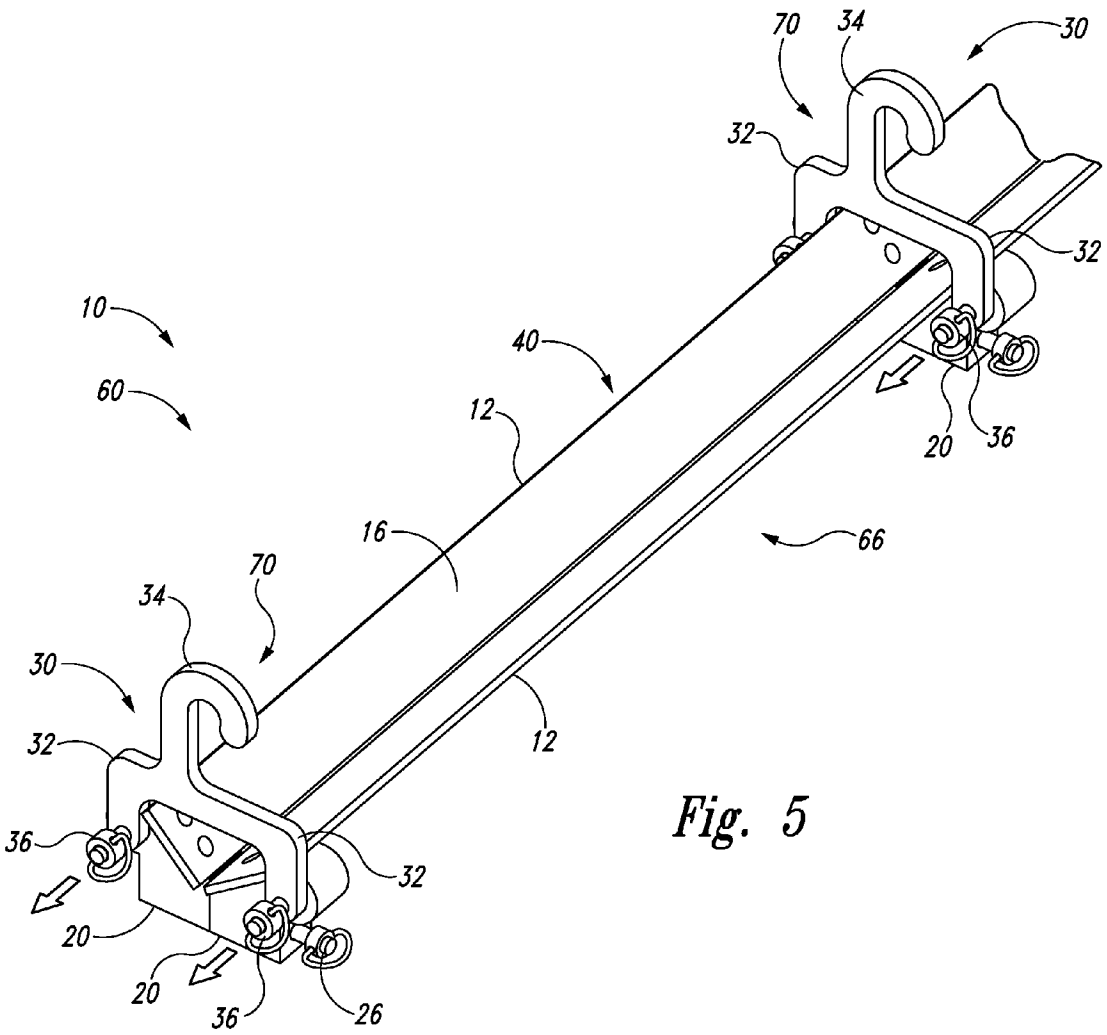
FIG. 5 is a perspective view of an illustrative, non-exclusive example of a radius filler transport tool showing arm coupler removal.

FIGS. 5-8 show an illustrative, non-exclusive example of a radius filler transport tool 10 in various states, illustrating the use of radius filler transport tool 10 to index an uncured radius filler 50 to a desired location (e.g., to transport an uncured radius filler 50 and/or to place an uncured radius filler 50 into a cavity 56 and/or a void formed in a composite structure 52, such as at the intersection of two uncured composite sheets 54). FIG. 5 shows an example radius filler transport tool 10 in a transport state 60 before any radius filler 50 (not shown in FIG. 5) is loaded into the radius filler transport tool 10. A radius filler 50 may be loaded into the radius filler transport tool 10 by transitioning the radius filler transport tool 10 from the transport state 60 (shown) to the load state 62 (not shown). In the transport state 60, hanger assemblies 30 are in the hanger closed state 70 and, thus, block a portion of the radius filler entrance 40 into the top of the trough 16. In this example, the radius filler transport tool 10 includes two trough portions 12. Further, two hanger assemblies 30, each coupled to both trough portions 12 and spanning the trough 16, are shown. Each hanger assembly 30 is pivotably coupled to each trough portion 12 with an arm coupler 36 (i.e., for each arm 32, one arm coupler 36 to couple the arm 32 to one trough portion 12). Each of the arm couplers 36 (each a pin) are also releasable and removable. To transition one of the hanger assemblies 30 from the hanger closed state 70 (shown) to the hanger open state 72 (not shown), and, thus, to transition the radius filler transport tool 10 from the transport state 60 to the load state 62, one or both of the arm couplers 36 may be removed, e.g., by sliding the arm couplers 36 in the directions of the bold arrows.

Figure 6:
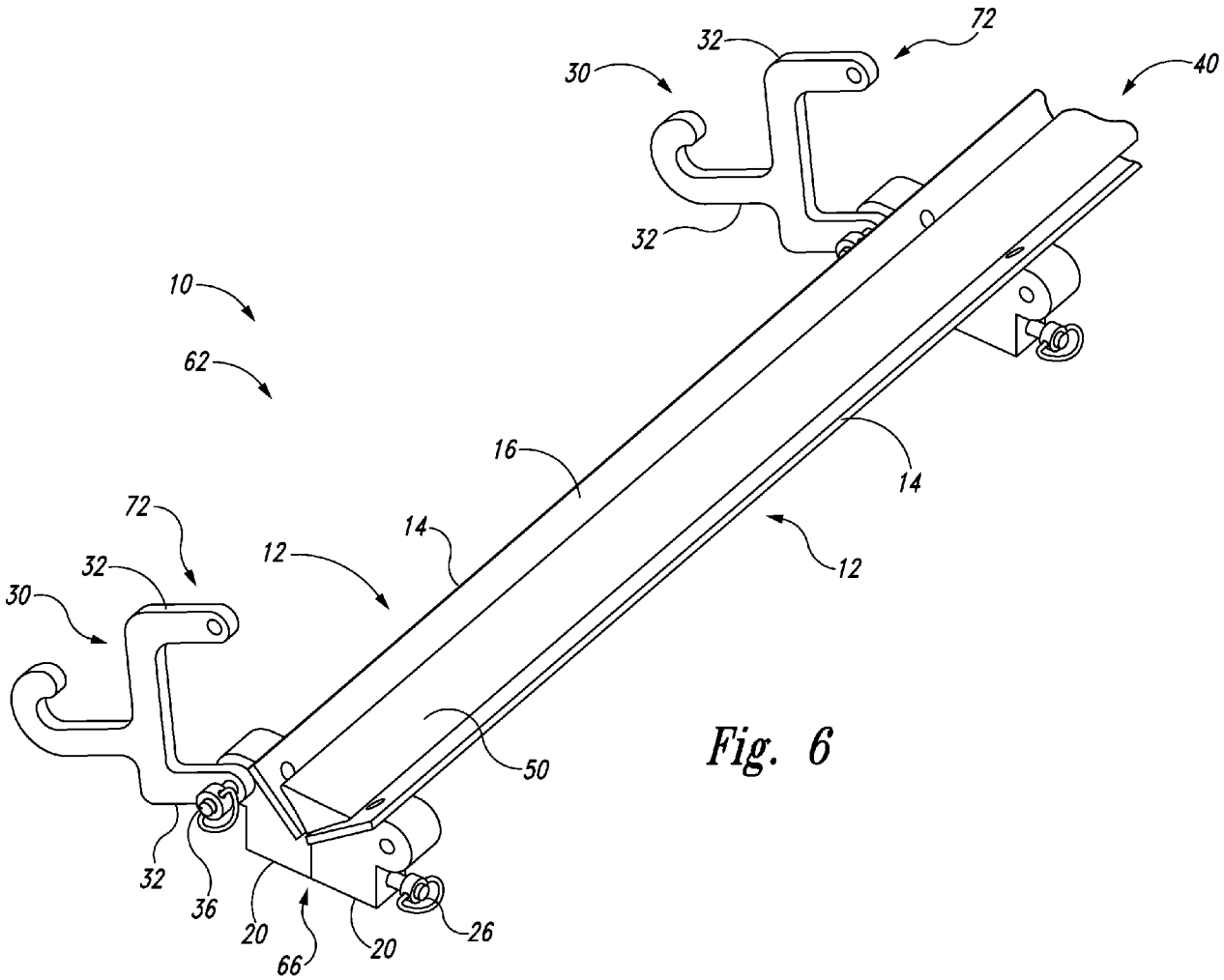
FIG. 6 is a perspective view of the radius filler transport tool of FIG. 5 in the load state.
Figure 7:
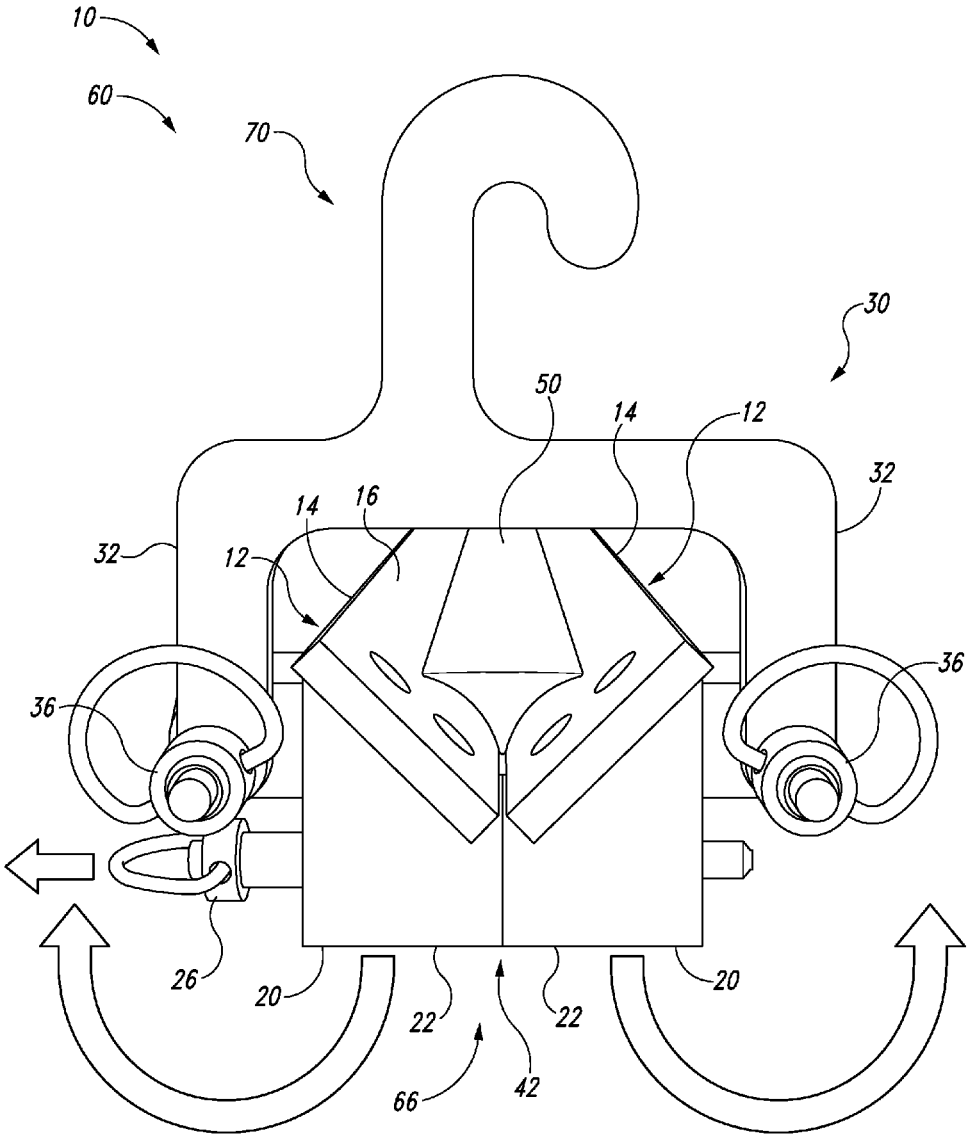
FIG. 7 is a perspective end view of the radius filler transport tool of FIG. 5 showing base coupler removal and trough portion motion.

As shown in FIG. 6, once one or both of the arm couplers 36 are removed, the corresponding hanger assembly 30 may be pivoted away from the top of the trough 16 and/or removed, fully exposing the radius filler entrance 40 in that location. Hence, the radius filler transport tool 10 of FIG. 6 is in the load state 62. Generally, each hanger assembly 30 independently may be in the hanger closed state 70 or the hanger open state 72. in FIG. 6, two hanger assemblies 30 are shown to be simultaneously in the hanger open state 72. In the load state 62, an uncured radius filler 50 may be loaded through the radius filler entrance 40 into the trough 16. That is, the radius filler 50 may be loaded from above the radius filler transport tool 10 into the trough 16 below. The radius filler 50 may be loaded one section at a time (e.g., by sequentially setting hanger assemblies 30 into the hanger open state 72 to expose the open top of the trough 16) or may be loaded substantially all at once (e.g., by previously setting all hanger assemblies 30 into the hanger open state 72). Hence, loading a radius filler 50 may include setting each hanger assembly 30 into the hanger open state 72 before and/or during the placement of the radius filler 50 into the trough 16. Before placing the radius filler 50 into the trough 16, if the trough 16 is not in the trough closed state 66, the trough 16 may be set into the trough closed state 66.

During and/or after loading the radius filler 50 into the radius filler transport tool 10 in the load state 62, the radius filler transport tool 10 may be transitioned to the transport state 60 (by setting the hanger assemblies 30 into the hanger closed state 66). For example, during and/or after placement of the radius filler 50 into the trough, each hanger assembly 30 may be set into the hanger closed state 70. As each hanger assembly 30 is set into the hanger closed state 70, that hanger assembly 30 is coupled (e.g., secured) to both trough portions 12 of the trough 16 (by connecting, replacing, etc.). When the hanger assemblies 30 are in the hanger closed state 70, the plurality of hanger assemblies 30 may be used to support the radius filler transport tool 10.

Once in the transport state 60 with the radius filler 50 loaded in the radius filler transport tool 10, the radius filler 50 may be transported in the radius filler transport tool 10. For example, the radius filler 50 in the radius filler transport tool 10 may be moved to the proximity of a cavity 56 and aligned above the cavity 56. The radius filler transport tool 10 may be supported and/or hung above the cavity 56 by hanging the radius filler transport tool 10 by the plurality of hanger assemblies 30.

Once ready to unload the radius filler 50, the radius filler transport tool 10 may be transitioned from the transport state 60 to the unload state 64 (by setting the trough into the trough open state 68). As shown by the bold straight arrow in FIG. 7, transitioning to the unload state 64 and to the trough open state 68 may include releasing, opening, and/or removing each of the base couplers 26 to leave the trough portions 12 free to pivot about the arm couplers 36 (as indicated by the bold curved arrows).

Figure 8:
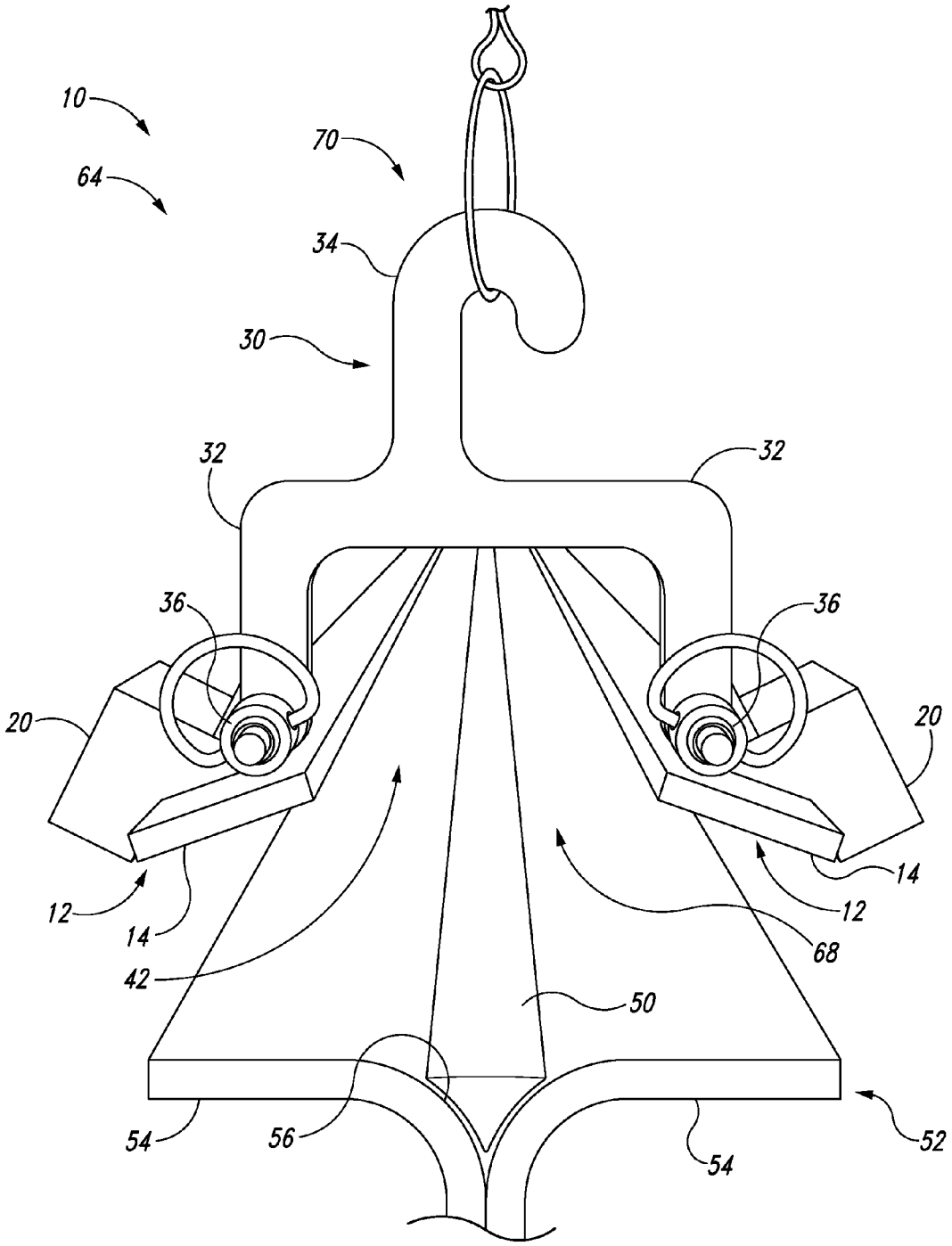
FIG. 8 is a perspective end view of the radius filler transport tool of FIG. 5 in the unload state.

FIG. 8 shows the radius filler transport tool 10 in the unload state 64 just after unloading the uncured radius filler 50 into a cavity 56 below. During unloading, the radius filler 50 generally is dropped through the open trough 16 (the trough 16 in the trough open state 68), through the radius filler exit 42, and directly below the radius filler transport tool 10. The radius filler 50 may be unloaded one section at a time (e.g., by sequentially releasing paired bases 20 of the trough portions 12 to open the trough 16 at that section) or may be unloaded substantially at once (e.g., by releasing all bases 20 from each other substantially simultaneously). When the radius filler 50 is unloaded by dropping through the radius filler exit 42, the radius filler 50 is dropped between the trough portions 12 (and, hence, between the trough panels 14). The unloading operation generally maintains the orientation of the radius filler 50 (i.e., the radius filler 50 as it is unloaded generally remains substantially in the same orientation as it was loaded). Further, the unloading operation generally is configured to avoid warping, kinking, and/or twisting the radius filler 50 as it is unloaded. For example, the dropping may be from a short height such as less than 100 mm, less than 50 mm, less than 40 mm, less than 30 mm, less than 25 mm, less than 20 mm, less than 15 mm, and/or less than 10 mm.

Figure 9:
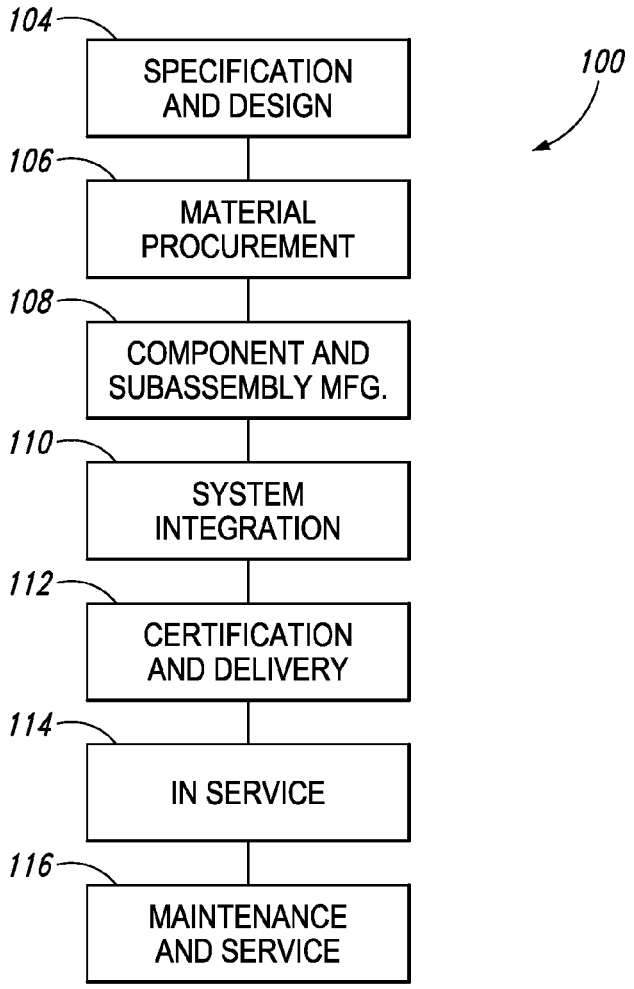
FIG. 9 is a flow diagram of aircraft production and service methodology.
Figure 10:
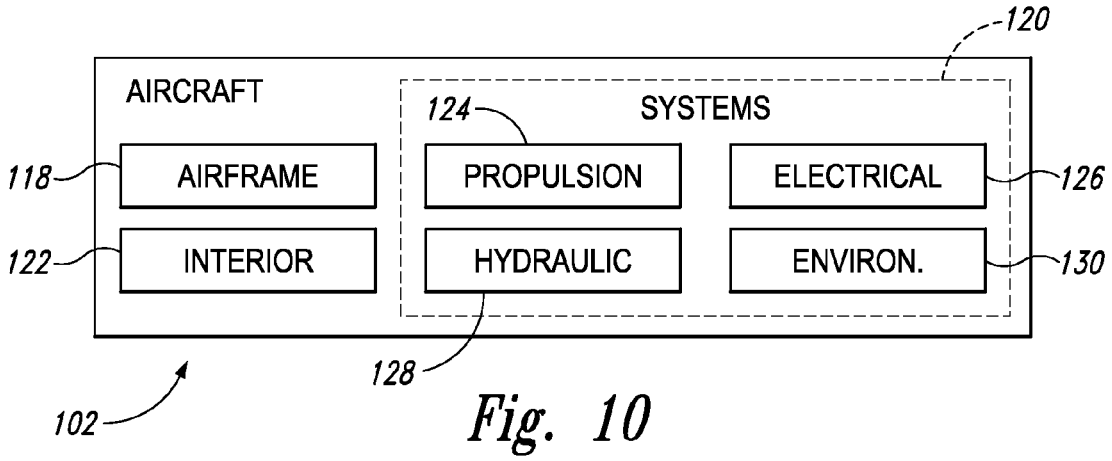
FIG. 10 is a block diagram of an aircraft.

Devices and methods of the present disclosure may be described in the context of an aircraft manufacturing and service method 100 as shown in FIG. 9 and an aircraft 102 as shown in FIG. 10. During pre-production, exemplary method 100 may include specification and design 104 of the aircraft 102 and material procurement 106. During production, component and subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 10, the aircraft 102 produced by exemplary method 100 may include an airframe 118 with a plurality of systems 120 and an interior 122. Examples of high-level systems 120 include one or more of a propulsion system 124, an electrical system 126, a hydraulic system 128, and an environmental system 130. Any number of other systems may be included. Although an aerospace example is shown, the principles of the invention may be applied to other industries, such as the automotive industry.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 102 is in service. Also, one or more apparatus embodiments, method embodiments, or a combination thereof may be utilized during the production stages 108 and 110, for example, by substantially expediting assembly of or reducing the cost of an aircraft 102. Similarly, one or more of apparatus embodiments, method embodiments, or a combination thereof may be utilized while the aircraft 102 is in service, for example and without limitation, to maintenance and service 116.

Illustrative, non-exclusive examples of inventive subject matter according to the present disclosure are described in the following enumerated paragraphs.

A1. A radius filler transport tool comprising:

a first trough portion and a second trough portion that are configured to couple together to form a trough, wherein the first trough portion includes a trough panel and a base, and wherein the second trough portion includes a trough panel and a base; and a plurality of hanger assemblies configured to transversely span the trough, wherein each hanger assembly includes a first arm and a second arm, wherein the first arm is configured to pivotably couple the hanger assembly to the first trough portion, and wherein the second arm is configured to pivotably couple the hanger assembly to the second trough portion.

A1.1. The radius filler transport tool of paragraph A1, wherein the trough has a trough closed state and a trough open state, wherein, in the trough closed state, the base of the first trough portion is releasably coupled to the base of the second trough portion, and wherein, in the trough open state, the base of the first trough portion is released from the base of the second trough portion.

A1.2. The radius filler transport tool of any of paragraphs A1-A1.1, wherein each hanger assembly has a hanger closed state and a hanger open state, wherein, in the hanger closed state, the first arm is pivotably coupled to the first trough portion, the second arm is pivotably coupled to the second trough portion, and the hanger assembly transversely spans the trough, and wherein, in the hanger open state, the first arm is released from at least one of the first trough portion and the second arm, A2. The radius filler transport tool of paragraphs A1-A1.2, wherein the radius filler transport tool has a transport state configured to hold an uncured radius filler in the trough between the first trough portion and the second trough portion, wherein the transport state is defined by the trough in the trough closed state and each hanger assembly in the hanger closed state.

A3. The radius filler transport tool of paragraphs A1-A1.2 or paragraph A2, wherein the radius filler transport tool has a load state configured to load an/the uncured radius filler from above the radius filler transport tool, wherein the load state is defined by the trough in the trough closed state and at least one, optionally each, hanger assembly in the hanger open state.

A3.1. The radius filler transport tool of paragraph A3, wherein the radius filler transport tool in the load state is configured to accept the uncured radius filler placed, dropped, and/or ejected into the trough of the radius filler transport tool from above.

A4. The radius filler transport tool of paragraphs A1-A1.1 or any of paragraphs A2-A3.1, wherein the radius filler transport tool has an unload state configured to downwardly unload an/the uncured radius filler from the radius filler transport tool, wherein the unload state is defined by the trough in the trough open state and each hanger assembly in the hanger closed state.

A4.1. The radius filler transport tool of any of paragraphs A2-A4, wherein the uncured radius filler is longer than 1 m, longer than 2 m, longer than 3 m, longer than 4 m, longer than 5 m, longer than 10 m, longer than 20 m, longer than 30 m, and/or longer than 40 m.

A4.2. The radius filler transport tool of any of paragraphs A2-A4.1, wherein the uncured radius filler has a cross sectional area that is less than 10 $cm^2$, less than 3 $cm^2$, less than 2 $cm^2$, less than 1 $cm^2$, less than 0.5 $cm^2$, less than 0.2 $cm^2$, greater than 0.1 $cm^2$, greater than 0.2 $cm^2$, and/or greater than 0.5 $cm^2$.

A4.3. The radius filler transport tool of any of paragraphs A2-A4.2, wherein the uncured radius filler includes, optionally is, composite material and/or fiber-reinforced composite, and optionally wherein the uncured radius filler includes at least one of resin, epoxy, adhesive, carbon fiber, glass fiber, and aramid fiber.

A4.4. The radius filler transport tool of any of paragraphs A4-A4.3, wherein the radius filler transport tool in the unload state is configured to drop, eject, and/or place the uncured radius filler from the trough into a cavity below the radius filler transport tool, optionally wherein the cavity is less than 100 mm, less than 50 mm, less than 40 mm, less than 30 mm, less than 25 mm, less than 20 mm, less than 15 mm, and/or less than 10 mm below the radius filler transport tool.

A5. The radius filler transport tool of any of paragraphs A1-A4.4, wherein the radius filler transport tool, the first trough portion, the trough panel of the first trough portion, the second trough portion, and/or the trough panel of the second trough portion is elongated.

A5.1. The radius filler transport tool of paragraph A5, wherein the radius filler transport tool, the first trough portion, and/or the second trough portion is longer than 1 m, longer than 2 m, longer than 3 m, longer than 4 m, longer than 5 m, longer than 10 m, longer than 20 m, longer than 30 m, and/or longer than 40 m.

A5.2. The radius filler transport tool of any of paragraphs A5-A5.1, wherein the trough panel of the first trough portion and/or the trough panel of the second trough portion is longer than 0.5 m, longer than 1 m, longer than 2 m, longer than 3 m, longer than 4 m, longer than 5 m, shorter than 5 m, shorter than 4 m, shorter than 3 m, shorter than 2 m, and/or shorter than 1 m.

A6. The radius filler transport tool of any of paragraphs A1-A5.2, wherein the first trough portion includes a plurality of trough panels.

A7. The radius filler transport tool of any of paragraphs A1-A6, wherein the second trough portion includes a plurality of trough panels.

A8. The radius filler transport tool of any of paragraphs A1-A7, wherein the trough panel of the first trough portion and/or the trough panel of the second trough portion is configured for non-damaging contact with an/the uncured radius filler.

A8.1. The radius filler transport tool of paragraph A8, wherein the trough panel of the first trough portion and/or the trough panel of the second trough portion is configured to avoid contaminating, sticking to, and/or negatively impacting the uncured radius filler.

A9. The radius filler transport tool of any of paragraphs A1-A8.1, wherein the first trough portion, the trough panel of the first trough portion, the second trough portion, and/or the trough panel of the second trough portion includes at least one of plastic, polyethylene, UHMW polyethylene, metal, aluminium, fluoropolymer, PTFE, FEP, EFTE, and silicone.

A10. The radius filler transport tool of any of paragraphs A1-A9, wherein the trough panel of the first trough portion and/or the trough panel of the second trough portion includes at least one of a release coating, a release film, and a dry release surface.

A11. The radius filler transport tool of any of paragraphs A1-A10, wherein the trough in the trough closed state has a depth that is greater than 5 mm, greater than 10 mm, greater than 15 mm, greater than 20 mm, greater than 25 mm, greater than 30 mm, less than 100 mm, less than 50 mm, less than 40 mm, and/or less than 30 mm.

A12. The radius filler transport tool of any of paragraphs A1-A11, wherein the trough in the trough closed state has a bottom that is less than 100 mm, less than 50 mm, less than 40 mm, less than 30 mm, less than 25 mm, less than 20 mm, less than 15 mm, and/or less than 10 mm above a bottom of the radius filler transport tool.

A13. The radius filler transport tool of any of paragraphs A1-A12, wherein the trough in the trough closed state has a length that is longer than 1 m, longer than 2 m, longer than 3 m, longer than 4 m, longer than 5 m, longer than 10 m, longer than 20 m, longer than 30 m, and/or longer than 40 m.

A14. The radius filler transport tool of any of paragraphs A1-A13, wherein the trough in the trough closed state is defined between the trough panel of the first trough portion and the trough panel of the second trough portion.

A15. The radius filler transport tool of any of paragraphs A1-A14, wherein the first trough portion includes a plurality of bases, optionally spaced apart along a length of the first trough portion, and optionally spaced apart by at least 1 m, at least 2 m, at least 3 m, at least 4 m, at least 5 m, about 1 m, about 1.5 m, and/or about 2 m.

A16. The radius filler transport tool of any of paragraphs A1-A15, wherein the second trough portion includes a plurality of bases, optionally spaced apart along a length of the second trough portion, and optionally spaced apart by at least 1 m, at least 2 m, at least 3 m, at least 4 m, at least 5 m, about 1 m, about 1.5 m, and/or about 2 m.

A17. The radius filler transport tool of any of paragraphs A1-A16, wherein the radius filler transport tool, optionally when the trough is in the trough closed state, is configured to stably rest on a flat surface, optionally with the base of the first trough portion and the base of the second trough portion contacting the flat surface.

A18. The radius filler transport tool of any of paragraphs A1-A17, wherein the base of the first trough portion includes a foot and/or wherein the base of the second trough portion includes a foot.

A18.1. The radius filler transport tool of paragraph A18, wherein the foot of the first trough portion and/or the foot of the second trough portion is configured to contact uncured composite materials without damage to the uncured composite materials.

A18.2. The radius filler transport tool of any of paragraphs A18-A18.1, wherein the foot of the first trough portion and/or the foot of the second trough portion includes at least one of plastic, polyethylene, UHMW polyethylene, metal, aluminium, fluoropolymer, PTFE, FEP, EFTS, and silicone.

A18.3. The radius filler transport tool of any of paragraphs A18-A18.2, wherein the foot of the first trough portion and/or the foot of the second trough portion includes at least one of a release coating, a release film, and a dry release surface.

A18.4. The radius filler transport tool of any of paragraphs A18-A18.3, wherein the foot of the first trough portion and/or the foot of the second trough portion is at a/the bottom of the radius filler transport tool.

A19. The radius filler transport tool of any of paragraphs A1-A18.4, further comprising a base coupler and wherein, in the trough closed state, the base of the first trough portion is releasably coupled to the base of the second trough portion by the base coupler.

A19.1. The radius filler transport tool of paragraph A19, wherein the base coupler includes at least one of a pin, a clamp, a clasp, a hinge, a magnet, and an actuator.

A20. The radius filler transport tool of any of paragraphs A1-A19.1, wherein each hanger assembly includes a first arm coupler and a second arm coupler.

A20.1. The radius filler transport tool of paragraph A20, wherein, in at least the hanger closed state, the first arm is pivotably, and optionally releasably, coupled to the first trough portion by the first arm coupler.

A20.2. The radius filler transport tool of any of paragraphs A20-A20.1, wherein, in at least the hanger closed state, the second arm is pivotably, and optionally releasably, coupled to the second trough portion by the second arm coupler.

A20.3. The radius filler transport tool of any of paragraphs A20-A20.2, wherein the first arm coupler and/or the second arm coupler includes at least one of a pin, a clamp, a clasp, a hinge, a magnet, an actuator, a hook, a ring, a carabiner, a link, a loop, and an eyelet.

A21. The radius filler transport tool of any of paragraphs A1-A20.3, wherein, in the hanger open state, the first arm is released from the first trough portion and/or the second arm is released from the second trough portion.

A22. The radius filler transport tool of any of paragraphs A1-A21, wherein, in the hanger open state, the first arm is released from the second arm.

A23. The radius filler transport tool of any of paragraphs A1-A22, wherein at least one, optionally each, hanger assembly includes a central hanger coupler.

A23.1. The radius filler transport tool of paragraph A23, wherein, in the hanger closed state, the first arm and the second arm are releasably coupled together by the central hanger coupler.

A23.2. The radius filler transport tool of any of paragraphs A23-A23.1, wherein the central hanger coupler includes at least one of a pin, a clamp, a clasp, a hinge, a magnet, an actuator, a hook, a ring, a carabiner, a link, a loop, and an eyelet.

A24. The radius filler transport tool of any of paragraphs A1-A23.2, wherein at least one, optionally each, hanger assembly includes a hanging coupler.

A24.1. The radius filler transport tool of paragraph A24, wherein the hanging coupler is configured to releasably couple the hanger assembly to a transport mechanism above the radius filler transport tool.

A24.2. The radius filler transport tool of any of paragraphs A24-A24.1, wherein the hanging coupler is configured to hang the radius transport tool.

A24.3. The radius filler transport tool of any of paragraphs A24-A24.2, wherein the hanging coupler includes, and optionally is, at least one of a hook, a ring, a carabiner, a link, a catch, a clasp, a grapple, a loop, a strap, a tether, and an eyelet.

A25. The use of the radius filler transport of any of paragraphs A1-A24.3 to index, to transport, and/or to place an uncured radius filler.

A26. The use of the radius filler transport of any of paragraphs A1-A24.3 to place an uncured radius filler into a cavity formed at the intersection of two uncured composite sheets.

B1. A method for handling an uncured radius filler, the method comprising:

loading the uncured radius filler into a radius filler transport tool by placing the uncured radius filler into the radius transport tool from above; and unloading the uncured radius filler from the radius filler transport tool by dropping the uncured radius filler from the radius filler transport tool.

B2. The method of paragraph B1, wherein the radius filler transport tool is the radius filler transport tool of any of paragraphs A1-A24.3 and/or includes a trough with a trough closed state and a trough open state, and a plurality of hanger assemblies configured to transversely span the trough, wherein each hanger assembly has a hanger closed state and a hanger open state.

B2.1. The method of paragraph B2, wherein the loading includes, at least one of before and during the placing, setting each hanger assembly into the hanger open state.

B2.2. The method of any of paragraphs B2-B2.1, wherein the loading includes, at least one of before and during the placing, transitioning each hanger assembly from the hanger closed state to the hanger open state, and wherein the loading includes, at least one of during and after the placing, transitioning each hanger assembly from the hanger open state to the hanger closed state.

B2.3. The method of any of paragraphs B2-B2.2, wherein the placing is performed while at least one, optionally each, of the hanger assemblies is in the hanger open state.

B2.4. The method of any of paragraphs B2-B2.3, wherein the loading includes, at least one of before and during the placing, releasing and/or removing the plurality of hanger assemblies to expose an open top of the trough.

B2.5. The method of any of paragraphs B2-B2.4, wherein the loading includes, at least one of after and during the placing, setting each hanger assembly into the hanger closed state.

B2.6. The method of any of paragraphs B2-B2.5, wherein the loading includes, at least one of after and during the placing, securing and/or replacing the plurality of hanger assemblies to support the radius filler transport tool.

B2.7. The method of any of paragraphs B2-B2.6, wherein the loading includes, before the placing, setting the trough into the trough closed state.

B2.8. The method of any of paragraphs B2-B2.7, wherein the loading is performed while the trough is in the trough closed state.

B2.9. The method of any of paragraphs B2-B2.8, wherein the placing includes placing the uncured radius filler into the trough.

B2.10. The method of any of paragraphs B2-B2.9, further comprising, before the unloading, hanging the radius filler transport tool by the plurality of hanger assemblies.

B2.11. The method of any of paragraphs B2-B2.10, wherein the unloading includes, at least one of before and during the dropping, setting the trough into the trough open state.

B2.12. The method of any of paragraphs B2-B2.11, wherein the unloading includes, at least one of before and during the dropping, transitioning the trough from the trough closed state to the trough open state while at least one of the hanger assemblies is in the hanger closed state.

B2.13. The method of any of paragraphs B2-B2.12, wherein the unloading is performed while the trough is in the trough open state.

B2.14. The method of any of paragraphs B2-B2.13, wherein the unloading includes, at least one of before and during the dropping, releasing the base of the first trough portion from the base of the second trough portion.

B2.15. The method of any of paragraphs B2-B2.14, further comprising, after the dropping, setting the trough into the trough closed state.

B2.16. The method of any of paragraphs B2-B2.15, further comprising, after the dropping, coupling the base of the first trough portion to the base of the second trough portion.

B2.17. The method of any of paragraphs B2-B2.16, wherein the dropping includes dropping the uncured radius filler between the first trough portion and the second trough portion, and/or between the trough panel of the first trough portion and the trough panel of the second trough portion.

B2.18. The method of any of paragraphs B2-B2.17, wherein the dropping includes dropping the uncured radius filler less than 100 mm, less than 50 mm, less than 40 mm, less than 30 mm, less than 25 mm, less than 20 mm, less than 15 mm, and/or less than 10 mm.

B2.19. The method of any of paragraphs B2-B2.18, wherein the dropping includes dropping the uncured radius filler in the same orientation as it was in the radius filler transport tool prior to the dropping and/or at the placing.

B2.20. The method of any of paragraphs B2-B2.19, wherein the dropping includes dropping the uncured radius filler without significantly warping, kinking, and/or twisting the uncured radius filler.

B3. The method of any of paragraphs B1-B2.20, wherein the uncured radius filler is longer than 1 m, longer than 2 m, longer than 3 m, longer than 4 m, longer than 5 m, longer than 10 m, longer than 20 m, longer than 30 m, and/or longer than 40 m.

B4. The method of any of paragraphs B1-B3, wherein the uncured radius filler has a cross sectional area that is less than 10 $cm^2$, less than 3 $cm^2$, less than 2 $cm^2$, less than 1 $cm^2$, less than 0.5 $cm^2$, less than 0.2 $cm^2$, greater than 0.1 $cm^2$, greater than 0.2 $cm^2$, and/or greater than 0.5 $cm^2$.

B5. The method of any of paragraphs B1-B4, wherein the uncured radius filler includes, optionally is, fiber-reinforced composite, and optionally wherein the uncured radius filler includes at least one of carbon fiber, glass fiber, and aramid fiber.

B6. The method of any of paragraphs B1-B5, further comprising transporting the uncured radius filler in the radius filler transport tool B6.1. The method of paragraph B6, wherein the transporting includes transporting the uncured radius filler in the radius filler transport tool to a cavity and aligning the uncured radius filler above the cavity.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function. Further, as used herein, the singular forms "a", "an" and "the" may be intended to include the plural forms as well, unless the context clearly indicates otherwise.

The various disclosed elements of apparatuses and steps of methods disclosed herein are not required of all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. A radius filler transport tool comprising:

a first trough portion and a second trough portion that are configured to couple together to form a trough, wherein the first trough portion includes a trough panel and a base, and wherein the second trough portion includes a trough panel and a base; and a plurality of hanger assemblies configured to transversely span the trough, wherein each hanger assembly includes a first arm and a second arm, wherein the first arm is configured to pivotably couple the hanger assembly to the first trough portion and wherein the second arm is configured to pivotably couple the hanger assembly to the second trough portion;

wherein the trough has a trough closed state and a trough open state, wherein, in the trough closed state, the base of the first trough portion is releasably coupled to the base of the second trough portion, and wherein, in the trough open state, the base of the first trough portion is released from the base of the second trough portion; and wherein each hanger assembly has a hanger closed state and a hanger open state, wherein, in the hanger closed state, the first arm is pivotably coulpled to the first trough portion, the second arm is pivotably coupled to the second trough portion, and the hanger assembly transversely spans the trough, and wherein, in the hanger open state, the first arm is released from at least one of the first trough portion and the second arm.

2. The radius filler transport tool of claim 1, wherein the radius filler transport tool has a transport state configured to hold an uncured radius filler in the trough between the first trough portion and the second trough portion, wherein the transport state is defined by the trough in the trough closed state and each hanger assembly in the hanger closed state.

3. The radius filler transport tool of claim 1, wherein the radius filler transport tool has a load state configured to load the uncured radius filler from above the radius filler transport tool, wherein the load state is defined by the trough in the trough closed state and at least one hanger assembly in the hanger open state.

4. The radius filler transport tool of claim 1, wherein the radius filler transport tool has an unload state configured to downwardly unload the uncured radius filler from the radius filler transport tool, wherein the unload state is defined by the trough in the trough open state and each hanger assembly in the hanger closed state.

5. The radius filler transport tool of claim 1, further comprising a base coupler and wherein, in the trough closed state, the base of the first trough portion is releasably coupled to the base of the second trough portion by the base coupler.

6. The radius filler transport tool of claim 1, wherein, in the hanger open state, the first arm is released from the first trough portion.

7. The radius filler transport tool of claim 1, wherein each hanger assembly includes a first arm coupler and a second arm coupler.

8. The radius filler transport tool of claim 7, wherein, in at least the hanger closed state, the first arm is pivotably and releasably coupled to the first trough portion by the first arm coupler; and wherein, in at least the hanger closed state, the second arm is pivotably coupled to the second trough portion by the second arm coupler.

9. The radius filler transport tool of claim 1, wherein the trough panel of the first trough portion and the trough panel of the second trough portion are configured for non-damaging contact with an uncured radius filler.

10. The radius filler transport tool of claim 1, wherein the first trough portion includes a plurality of bases, spaced apart along a length of the first trough portion, and wherein the second trough portion includes a plurality of bases, spaced apart along a length of the second trough portion.

11. The radius filler transport tool of claim 1, wherein the base of the first trough portion includes a foot, wherein the base of the second trough portion includes a foot, and wherein the foot of the first trough portion and the foot of the second trough portion are configured to contact uncured composite materials without damage to the uncured composite materials.

12. The radius filler transport tool of claim 1, wherein each hanger assembly includes a hanging coupler configured to hang the radius transport tool.

13. A radius filler transport tool comprising:

a first trough portion and a second trough portion that are configured to couple together to form a trough, wherein the first trough portion includes a trough panel and a base, and wherein the second trough portion includes a trough panel and a base; and a plurality of hanger assemblies configured to transversely span the trough, wherein each hanger assembly includes a first arm and a second arm, wherein the first arm is configured to pivotably couple the hanger assembly to the first trough portion, and wherein the second arm is configured to pivotably couple the hanger assembly to the second trough portion;

wherein the trough panel of the first trough portion and the trough panel of the second trough portion are configured for non-damaging contact with an uncured radius filler.

14. The radius filler transport tool of claim 13, wherein the trough panel of the first trough portion and the trough panel of the second trough portion are configured to avoid contaminating the uncured radius filler.

15. The radius filler transport tool of claim 13, wherein the trough panel of the first trough portion and the trough panel of the second trough portion each independently include at least one of a release coating, a release film, and a dry release surface.

16. The radius filler transport tool of claim 13, wherein each hanger assembly has a hanger closed state and a hanger open state, wherein, in the hanger closed state, the first arm is pivotably coupled to the first trough portion, the second arm is pivotably coupled to the second trough portion, and the hanger assembly transversely spans the trough, wherein, in the hanger open state, the first arm is released from at least one of the first trough portion and the second arm; and wherein each hanger assembly includes a first arm coupler and a second arm coupler, wherein, in at least the hanger closed state, the first arm is pivotably and releasably coupled to the first trough portion by the first arm coupler, and wherein, in at least the hanger closed state, the second arm is pivotably coupled to the second trough portion by the second arm coupler.

17. A radius filler transport tool comprising:

a first trough portion and a second trough portion that are configured to couple together to form a trough, wherein the first trough portion includes a trough panel and a base, and wherein the second trough portion includes a trough panel and a base; and a plurality of hanger assemblies configured to transversely span the trough, wherein each hanger assembly includes a first arm and a second arm, wherein the first arm is configured to pivotably couple the hanger assembly to the first trough portion, and wherein the second arm is configured to pivotably couple the hanger assembly to the second trough portion;

wherein the base of the first trough portion includes a foot, wherein the base of the second trough portion includes a foot, and wherein the foot of the first trough portion and the foot of the second trough portion are configured to contact uncured composite materials without damage to the uncured composite materials.

18. The radius filler transport tool of claim 17, wherein the foot of the first trough portion and the foot of the second trough portion each independently include at least one of a release coating, a release film, and a dry release surface.

19. The radius filler transport tool of claim 17, further comprising a base coupler;

wherein the trough has a trough closed state and a trough open state, wherein, in the trough closed state, the base of the first trough portion is releasably coupled to the base of the second trough portion by the base coupler, and wherein, in the trough open state, the base of the first trough portion is released from the base of the second trough portion.

20. The radius filler transport tool of claim 19, wherein the base coupler includes a pin.

* * * * *